US005110184A

United States Patent [19]

Stein et al.

[11] Patent Number: 5,110,184

[45] Date of Patent: May 5, 1992

[54] ROTATABLE BEACH CHAIR

[76] Inventors: Scott C. Stein; Craig B. Stein; Sean T. Stein, all of 415 Coral Way, Ft. Lauderdale, Fla. 33301

[21] Appl. No.: 751,560

[22] Filed: Aug. 29, 1991

[51] Int. Cl.[5] ..... A47C 1/02

[52] U.S. Cl. ..... 297/349; 297/184; 297/191; 297/194

[58] Field of Search ..... 297/349, 184, 191, 194, 297/331, 335, DIG. 4

[56] References Cited

U.S. PATENT DOCUMENTS

| | | | |
|---|---|---|---|
| 401,302 | 4/1889 | Purdy . | |
| 901,761 | 10/1908 | Weber . | |
| 1,218,357 | 3/1917 | Bauer . | |
| 1,377,063 | 5/1921 | Gaj | 297/184 X |
| 1,397,675 | 11/1921 | Bushe . | |
| 1,575,162 | 3/1926 | Hatiwine . | |
| 1,660,494 | 2/1928 | Robertson . | |
| 1,956,956 | 5/1934 | Ieibo . | |
| 2,137,799 | 11/1938 | Brandenburg . | |
| 2,620,021 | 12/1952 | Mulia | 297/184 |
| 2,840,092 | 6/1958 | Hill . | |
| 2,857,957 | 10/1958 | Gay . | |
| 2,899,153 | 8/1959 | Parker . | |
| 3,058,711 | 10/1962 | Kingsford . | |
| 3,220,766 | 11/1965 | Kates | 297/184 |
| 3,237,904 | 3/1966 | Aruzese . | |
| 3,325,135 | 6/1967 | Clarke . | |
| 3,622,201 | 11/1971 | Radig | 297/184 X |
| 3,910,631 | 10/1975 | Inaba . | |
| 3,935,874 | 2/1976 | Cohen | 297/184 X |
| 3,955,849 | 5/1976 | Grebow et al. . | |
| 4,079,908 | 3/1978 | Davis . | |
| 4,085,686 | 4/1978 | Turner et al. . | |
| 4,098,478 | 7/1978 | Spitzke . | |
| 4,318,567 | 3/1982 | Guthier | 297/184 |
| 4,454,824 | 6/1984 | Wood . | |
| 4,586,207 | 5/1986 | Cornette . | |
| 4,778,142 | 10/1988 | Roba . | |
| 4,789,200 | 12/1988 | Munguia | 297/184 |
| 4,824,170 | 4/1989 | Goldmeier | 297/349 |
| 4,852,835 | 8/1989 | Ciulli . | |
| 4,920,897 | 5/1990 | Reed et al. . | |
| 4,977,848 | 12/1990 | Currey | 297/349 X |

FOREIGN PATENT DOCUMENTS

| | | | |
|---|---|---|---|
| 1502686 | 3/1978 | United Kingdom | 297/349 |

*Primary Examiner*—Laurie K. Cranmer

*Attorney, Agent, or Firm*—Hill, Van Santen, Steadman & Simpson

[57] ABSTRACT

A novel beach chair which is supported on a spike that is connected to the lower portion of the chair by a bearing arrangement such that when the spike is inserted into the ground the upper portion upon which a person is seated can be rotated relative to the lower portion of the spike to allow the seat to be rotated so as to follow the sun or for other purposes. Umbrella and pockets are also provided on the chair as well as a handle and ground wheels for moving the chair to and from the beach.

6 Claims, 2 Drawing Sheets

ROTATABLE BEACH CHAIR

BACKGROUND OF THE INVENTION

1. Field of the Invention

This invention relates in general to beach chairs and in particular to a novel rotatable beach chair.

2. Description of Related Art

Beach chairs per se are old in the art as indicated by the following U.S. Pat. Nos. 401,302, 901,761, 1,218,357, 1,397,675, 1,575,162, 1,660,494, 1,956,956, 2,137,799, 2,840,092, 2,857,957, 2,899,153, 3,058,711, 3,237,904, 3,325,135, 3,910,631, 3,955,849, 4,079,908, 4,085,686, 4,098,478, 4,318,567, 4,454,824, 4,586,207, 4,778,142, 4,852,835, 4,920,897.

SUMMARY OF THE INVENTION

The present invention provides a novel beach chair which is rotatable and includes a beach chair with a downwardly extending spike which is attached to the seat of the beach chair and in which a bearing is provided so as to rotatably support the chair from the spike such that if a user is seated in the chair he can rotate the chair so as to continually follow the sun. The bearing in the supporting spike allows free rotation of the chair about the axis of the spike. Other features of the chair include a detachable, adjustable umbrella, a bracket for supporting a beverage and one or more pockets mounted to the chair for holding umbrellas, tanning lotion, cigarettes, keys, money, etc. A handle is attached to the chair and also ground wheels are provided so that the chair can be easily rolled by the user over the ground.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
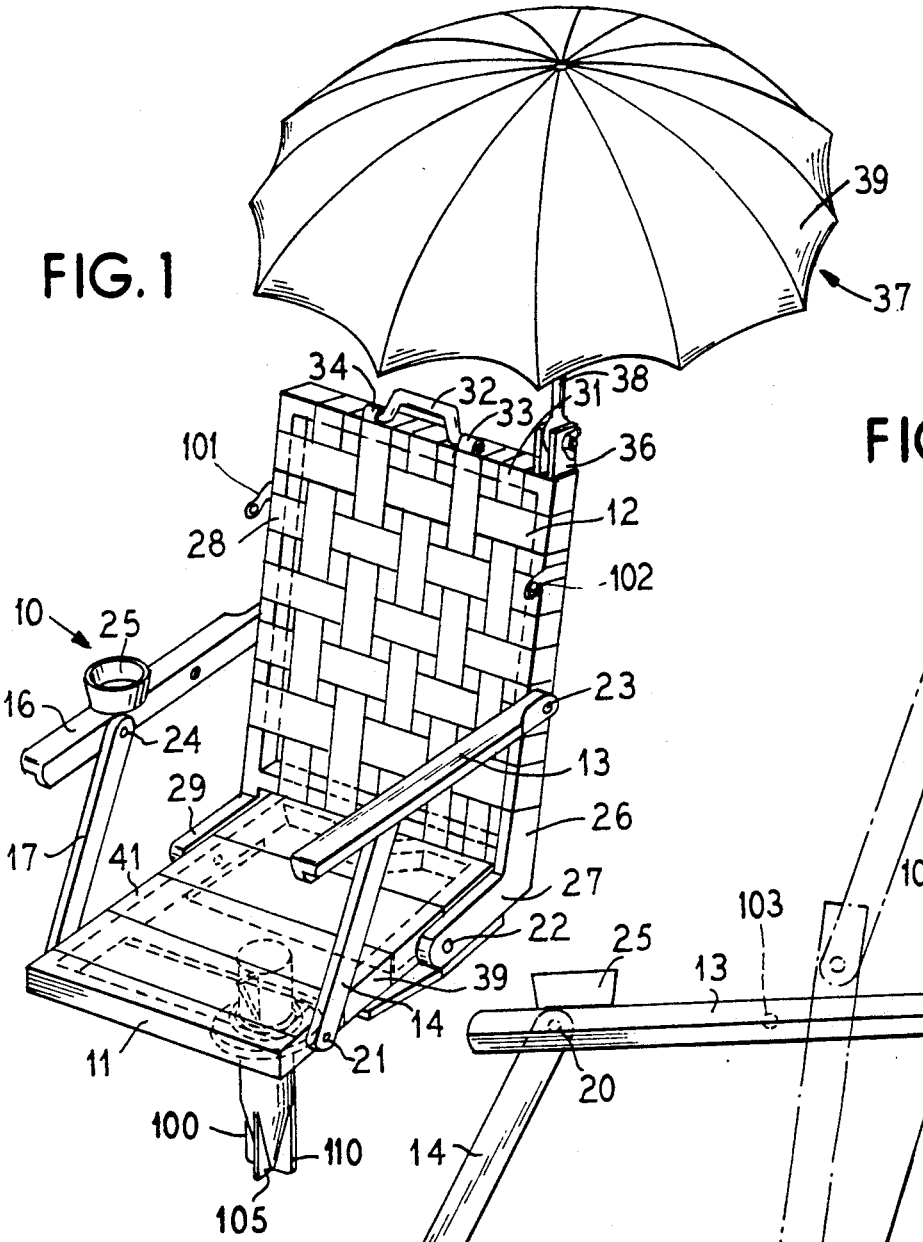
FIG. 1 is a perspective view illustrating the novel chair of the invention.
Figure 2:
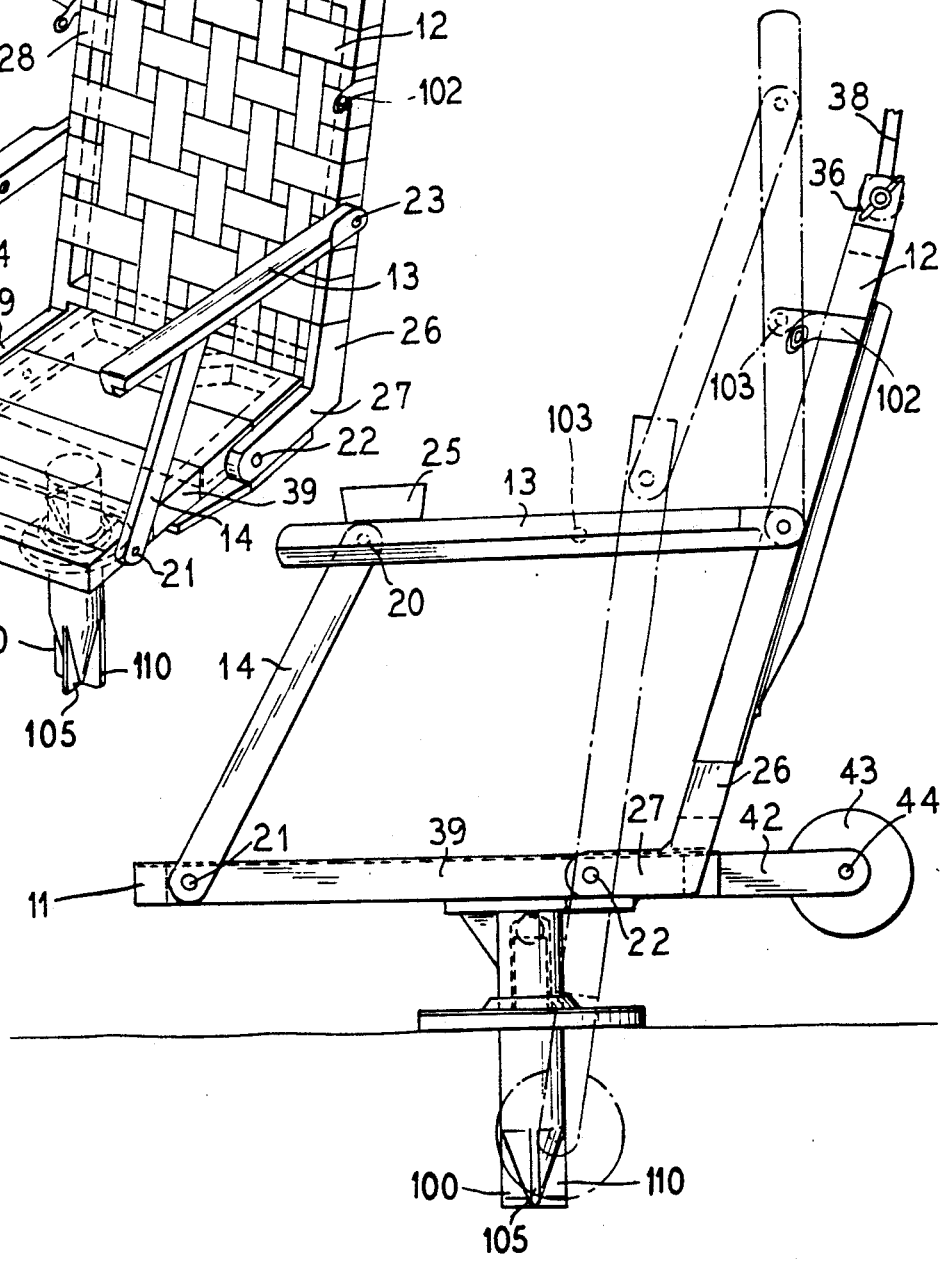
FIG. 2 is a side plan view of the invention.

FIGS. 1 and 2 illustrate the novel beach chair of the invention 10 which comprises a seat portion 11 that has side frame members 39 and 41 and cross-side frame members which connect the side frame members to form a seat to which is pivotally connected a backrest member 12 as connected by extending portions 27 and 29 through which pivot pins 22 extend to pivotally connect it to the seat 11. Arms 13 and 16 are pivotally connected to the back 12 by pivot pins 23 and arm supports 14 and 17 are pivotally connected to the seat 11 by pivot pins 21 and are pivotally connected to the arm portions 13 and 16 by pivot pins 24 and 20.

The seat 11 and back 12 are covered by suitable webbing 28 which may be made out of nylon or other suitable material interwoven to provide a backrest and a seat. The top frame member 31 carries a pair of brackets 33 and 34 into which a carrying handle 32 is mounted. An umbrella support bracket 36 pivotally supports an umbrella 37 that has a canopy 39 and a shaft 38 which is pivotally connected by a set screw to the bracket 36 as shown in FIGS. 1 and 2.

The portions 27 and 29 are connected to the lower portions 26 of the back 12 as shown in FIGS. 1 and 2. Straps 101 and 102 are connected to the back 12 and carry snap portions which are detachably connected to mating snap receptacles 103 on the seat 11 so as to hold the seat in the folded position for carrying it to and from the beach.

A cup or drink receptacle 25 is mounted to the arm 16 for receiving a beverage container therein.

As shown in FIG. 2, a pair of ground wheels such as 43 may be connected to the sides of the seat by extension members 42 which pivotally support wheels 43 on pivot shafts 44.

Figure 3:
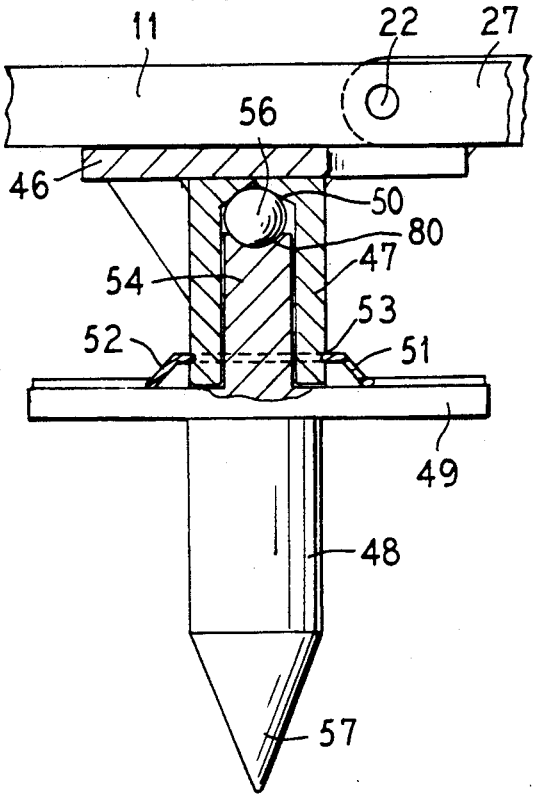
FIG. 3 is a detailed partially sectional view illustrating the spike structure of the chair.

FIG. 3 illustrates the novel spike and pivot support of the chair. A supporting bracket 46 is attached to the underside of the seat 11 and carries an extending cylindrical portion 47 which is formed with a hollow opening 50 in which a bearing 56 is mounted. A spike 48 has an upwardly extending portion 54 which is mounted in the opening of cylindrical member 47 and has a bearing socket 80 in which the bearing 56 is received. The spike portion 48 has a point 57 which can be inserted into the sand to support the beach chair 10. An extending plate 49 is attached to spike 48 and has upwardly extending portions 51 and 52 which are received in a groove 53 of the portion 47 to prevent the spike 48 from separating from the portion 47. In operation, the chair is mounted so that the spike 48 is inserted into the sand and then as the person sits in the seat he can rotate it on the bearing 56 to different directions as the sun moves about the sky. The plate 49 limits the insertion of the spike into the sand.

Figure 4:
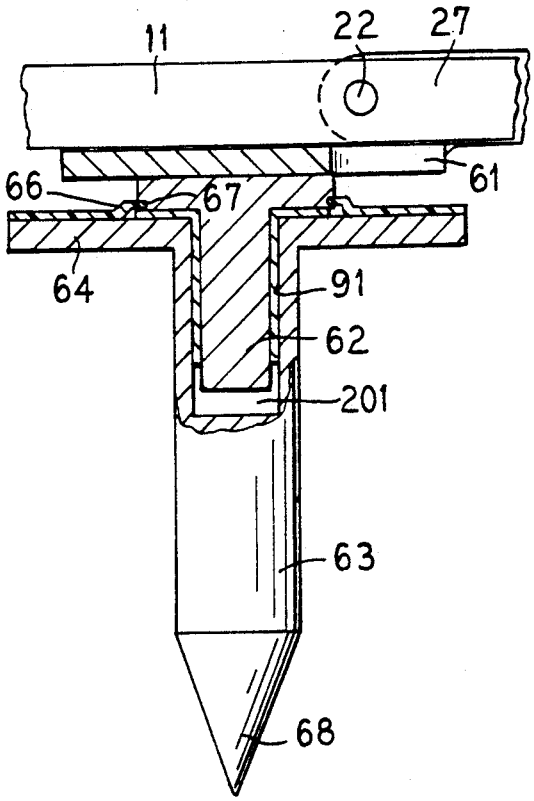
FIG. 4 illustrates a modified form of the spike structure of the chair.

FIG. 4 illustrates a modified form of the invention wherein a plate 61 is attached to the bottom of the seat and has an extension of generally cylindrical shape 62 that is received in an opening 201 of a spike 63. A bearing 91 which may be made of a suitable plastic such as polyethylene is received on the top of a flange 64 attached to the spike 63 and fits into the opening 201 between the extension 62 and the inner walls of the opening 201 so as to provide a bearing between the portion 62 and the spike 63. A flange 66 fits into a groove 67 formed in the upper portion of the member 62 to hold the assembly together. The point 68 is inserted into the sand and the chair can be rotated relative to the spike 63 on the bearing 91 as desired.

Figure 5:
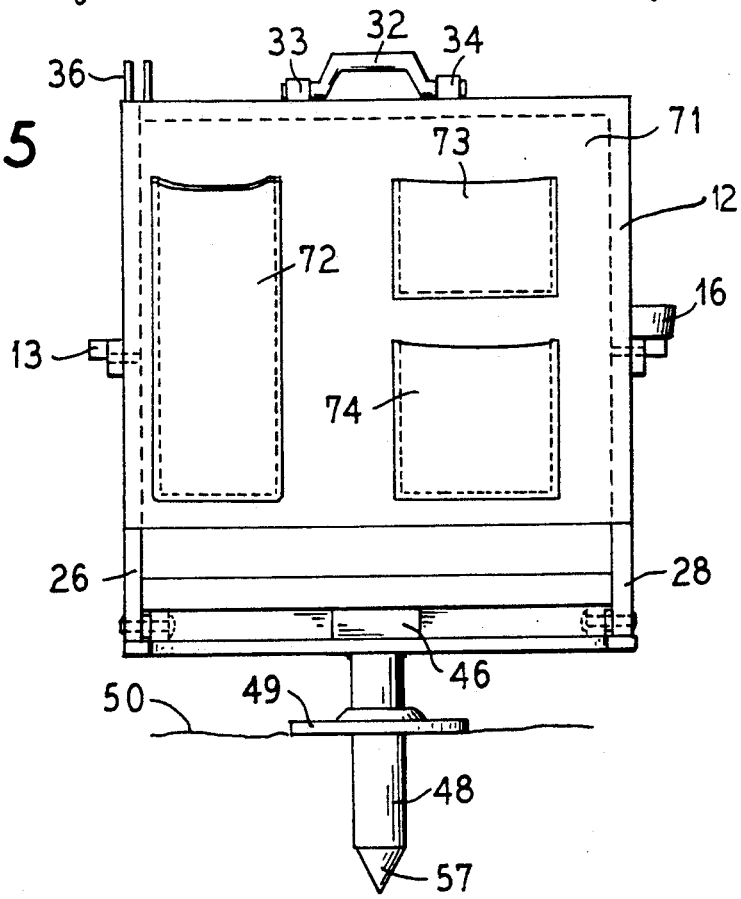
FIG. 5 is a back plan view of the chair illustrating the netting and pockets for holding various items.

FIG. 5 illustrates the back 12 of the chair which has a backside 71 upon which suitable pockets 72, 73 and 74 are mounted so as to receive and hold various objects such as an umbrella, wallet, keys and other items which might be used by the user. Such things as sun lotion and other protective lotions and even articles of clothing can be placed in such pockets. Velcro straps and pocket covers can be provided to close the pockets and to attach various items to the chair.

An umbrella 37 can be removed from the chair by removing it from the bracket 36 and folding it up and inserting it in the pocket 72, for example.

FIG. 1 illustrates a modified form of a lower portion of the spike 100 which is formed with flanges 105 and 110 so as to prevent the lower portion of the spike from rotating in the sand.

FIG. 2 illustrates in dotted form the method of folding the chair so as to carry it to and from the beach. In the folded condition, the straps 102 and 101 are connected to the associated snaps 103 on the arm rests 13 and 16 and the wheels 43 pivot to the dash dot position shown in FIG. 2 so that the chair can be moved over the ground by using the handle 32 and rolling it on the wheels 43. It is to be realized, of course, that there is a wheel 43 on each side of the chair, but only the wheel 43 on the near side of the chair relative to FIG. 2 is illustrated.

Although the invention has been described with respect to preferred embodiments, it is not to be so limited as changes and modifications can be made which are within the full intended scope of the invention as defined by the appended claims.

We claim as our invention:

1. An improved beach chair having a seat portion and a back portion pivotally connected together, a pair of arm rests and arm rest supports pivotally connected to said seat portion and back portion, a ground engaging spike connected to said seat portion and said spike rotatably mounted to said seat portion so that said beach chair can be rotated relative to said spike, wherein said spike has a first pointed ground engaging portion and a second portion which is attached to said seat portion and which is rotatably connected to said first pointed ground engaging portion of said spike, wherein a bearing is mounted between said first pointed ground engaging portion and said second portion which is attached to said seat portion, and wherein said second portion which is attached to said seat portion is formed with a cylindrical-shaped opening and said first pointed portion has an extension which is received within said cylindrical-shaped opening and said bearing is mounted in said cylindrical-shaped opening between said first and second portions of said spike.

2. An improved beach chair according to claim 1 including ground wheels attached to said chair for moving it.

3. An improved beach chair according to claim 1 including a beverage holder attached to said chair.

4. An improved beach chair according to claim 1 including an umbrella attached to said chair.

5. An improved beach chair according to claim 1 including pockets attached to said chair.

6. An improved beach chair according to claim 1 wherein said first portion pointed ground engaging portion of said spike is formed with flanges so as to prevent it from rotating when inserted in the ground.

* * * * *